US005355143A

United States Patent [19]

Zürcher et al.

[11] Patent Number: 5,355,143

[45] Date of Patent: Oct. 11, 1994

[54] ENHANCED PERFORMANCE APERTURE-COUPLED PLANAR ANTENNA ARRAY

[75] Inventors: Jean F. Zürcher, Tavel sur Clarens; John R. Sanford, Oberutzwil; Kuno Wettstein, Schwellbrunn; Richard C. Hall, Herisau, all of Switzerland

[73] Assignee: Huber & Suhner AG, Kabel-, Kautschuk-, Kunststoffwerke, Herisau, Switzerland

[21] Appl. No.: 82,905

[22] Filed: Jun. 28, 1993

Related U.S. Application Data

[63] Continuation of Ser. No. 847,301, Mar. 6, 1992, abandoned.

[30] Foreign Application Priority Data

Mar. 6, 1991 [CH] Switzerland ..... 680/91
Dec. 4, 1991 [CH] Switzerland ..... 3584/91

[51] Int. Cl.[5] ..... H01Q 1/38; H01Q 13/10

[52] U.S. Cl. ..... 343/700 MS; 343/767; 343/770

[58] Field of Search ..... 343/700 MS, 767, 778, 343/768, 770, 829, 845, 846, 847, 848; H01Q 1/38

[56] References Cited

U.S. PATENT DOCUMENTS 4,761,654 8/1988 Zaghloul ..... 343/700 MS
4,816,835 3/1989 Abiko et al. ..... 343/700 MS
4,843,400 6/1989 Tsao et al. ..... 343/700 MS
4,926,189 5/1990 Zaghloul et al. ..... 343/700 MS
4,929,959 5/1990 Sorbello et al. ..... 343/700 MS
4,943,809 7/1990 Zaghloul ..... 343/700 MS
5,005,019 4/1991 Zaghloul et al. ..... 343/700 MS
5,008,681 4/1991 Gavallaro et al. ..... 343/700 MS

FOREIGN PATENT DOCUMENTS 0253128 6/1987 European Pat. Off. ..... H01Q 21/24
0342175 5/1989 European Pat. Off. ..... H01Q 9/04

OTHER PUBLICATIONS

*Electronics Letters,* No. 23, 24:1433–35 (Nov. 1988).
Papiernik et al., *Antennes Microrubans A Large Bande Alimentees Par Ouverture,* 6es Journees Nationales Microondes (Jun. 1989) pp. 113–114.
*1990 International Symposium Digest Antennas and Propogation, I.E.E.E.,* vol. III, pp. 1154–1157 (May 1990).

*Primary Examiner*—Donald Hajec
*Assistant Examiner*—Hoanganh Le
*Attorney, Agent, or Firm*—Rothwell, Figg, Ernst & Kurz

[57] ABSTRACT

A flat antenna is disclosed which consists of a substrate having applied thereto an electrically conductive elements, or patches, in a pattern and a metal layer having a slot pattern aligned with the patches, as well as a distribution network mounted on both sides thereof a layer of foamed material. The antenna further includes a reflector consisting of a metal plate. The external surface of the antenna, consisting of a glass substrate surface, can easily be cleaned. Such an antenna can be manufactured inexpensively by using glass and a foamed material. The various patch patterns can be created by screen printing or metallization. The propagation pattern may be shaped as desired the antenna constructed according to the present invention.

14 Claims, 3 Drawing Sheets

ENHANCED PERFORMANCE APERTURE-COUPLED PLANAR ANTENNA ARRAY

This is a continuation of application Ser. No. 07/847,301, filed Mar. 6, 1992, now abandoned.

BACKGROUND OF THE INVENTION

1. Field of the Invention

The invention relates to a planar antenna in general and, more specifically, to a planar antenna with a directional pattern adjustable by means of an adjustment feed by way of a passive network.

2. Description of the Background Art

Microstrip beam antennas are well known in the art and present a number of disadvantages, e.g. narrow bandwidth and low efficiency, in addition to their essential advantages which result from desirable dimensions, simplicity of manufacture, and compatibility with printed circuits. In many respects, the manufacturing technology employed in microstrip antennas has not met established environmental specifications, which has resulted in these antennas being used only to a limited extent.

EP-A-O 253,128 describes a planar suspended conductor antenna array comprising tiered substrates between a pair of conducting plates. Each plate has openings spaced at intervals that define radiation elements. At least one exciter probe on a substrate has a plurality of openings. The signals received with these exciter probes are input to a suspended conductor in phase by means of conducting films. Holders for the substrate are mounted around the openings. The substrate is accordingly evenly supported and cannot warp. There are a number of wide grooves in the printed circuit boards between each row of adjacent openings, in which a plurality of suspended conductors are tip-stretched parallel to each other.

Antennas of this type are provided for high-frequency satellite transmissions. Because of the simplicity of the design, manufacturing costs can be lowered while high performance characteristics are achieved.

With an antenna having the above-described structure, the radiation pattern is exclusively in the form of a beam, such as is known, for example, from radar engineering.

A similar method is discussed in an article in *Electromagnetics*, Vol. 9, 1989, pages 385–393. This article describes a further development which is an antenna designed as a strip-slot-foam-inverted patch (SSFIP) antenna.

This SSFIP antenna is formed having tiered layer structure. Specifically, the SSFIP comprises a microstrip (S strip) with a quarter-wave stub, a slotted base, a foam layer characterized by slight attenuation and low relative permittivity, and lastly, an inverted radiating element in the form of a patch printed on a cover (inverted patch). One advantage of an antenna of this type is represented by simplicity in achieving circular polarization, and the possibility of operating two polarizations simultaneously.

In this design, the foam layer prevents surface wave propagation and increases the bandwidth.

There are several problems associated with the known SSFIP antennas described above. For example, there is a need for these antennas to be assembled with simpler and less expensive materials. Also, these known antennas have not been amenable to tailoring the radiation to specific needs.

The present invention is directed to overcoming the problems associated with the prior art antennas as will become apparent from the features described and claimed as follows.

SUMMARY OF THE INVENTION

In accordance with the present invention, a planar antenna is disclosed comprising a substrate having applied thereto electrically conductive elements, or patches, and a metal layer having a slot pattern wherein the slots and patches are aligned, as well as a base substrate. Also, supported between the metal layer and base substrate is a strip conductor network wherein a first foam material layer is formed between the network and metal layer and a second layer of foamed material is formed between the conductor network and the base substrate. The external surface of the antenna consists of glass and can be easily cleaned. The planar antenna according to the present invention can be manufactured inexpensively and enables propagation patterns to be easily shaped as desired.

BRIEF DESCRIPTION OF THE DRAWINGS

The invention is described as follows with reference to the drawings, in which.

DETAILED DESCRIPTION OF THE PREFERRED EMBODIMENT

Figure 1:
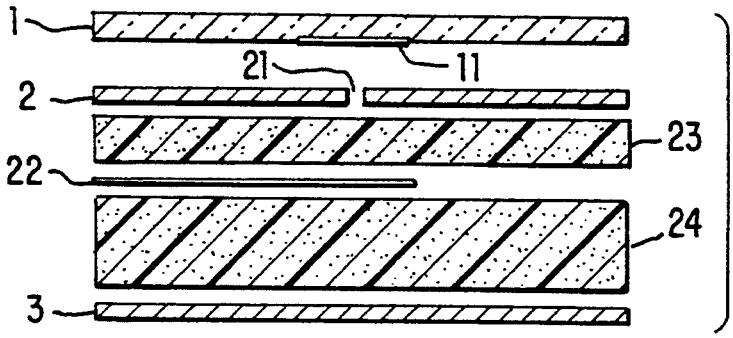
FIG. 1 illustrates a cross-section view of an antenna according to one embodiment of the present invention.
Figure 3A:
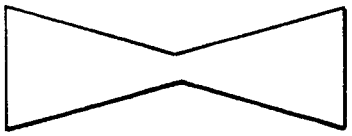
FIG. 3*a* is a schematic representation of a butterfly shaped coupling slot.
Figure 3B:
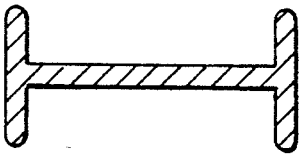
FIG. 3*b* is a schematic representation of a coupling slot shaped in the form of the letter H.

In accordance with one embodiment of the invention, FIG. 1 illustrates a planar antenna which comprises four elements: a carrier plate 1, a metal layer 2, strip conductor feeding network 22 and a ground plane 3. The carrier plate 1 is preferably made of glass or a fiber composite, on which radiation elements 11 may be vacuum deposited or applied by a printing process as inverted radiating antenna elements. Planar radiation elements 11 of this kind are also called patches.

In the state-of-the-art arrangement described in the above-referenced article in *Electromagnetics*, Volume 9, 1989, pages 385–393, there is a foam insert behind these inverted radiation patches. It has been found, however, that surface wave propagation does not occur to the extent expected, which enables this layer to be omitted.

If this layer is omitted, the following slot radiating layer can be positioned closer to the plane of the inverted radiating patches.

In contrast, the present claimed invention provides a foam dielectric layer 23 between the metal layer 2 with radiation openings 21 and strip conductor network 22 on one side, and a foam layer 24 between the latter and the ground plane 3. Ground plane 3 consists of metal or of a layer of metal deposited on a base. In addition, polystyrene, polypropylene, or polyamide are suitable as foamed materials.

In any event, the foam layer must possess both low density and a low relative permittivity.

In a preferred embodiment, the two foam layers 23 and 24 are not of equal thickness. Also according to a preferred embodiment, the thinner of the two, layer 23, is mounted on the coupling side and the thicker, layer 24, is mounted between the strip conductor network 22 and the ground plane 3.

Figure 8:
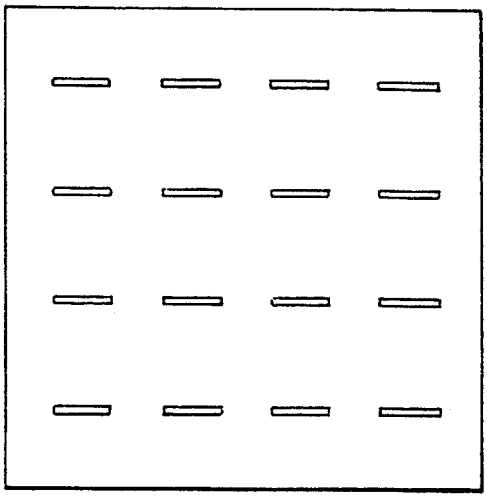
FIG. 8 is a top view of a coating of a coupling network with slotted openings according to one embodiment of the present invention.
Figure 9:
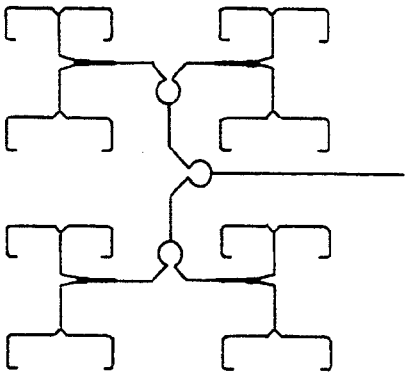
FIG. 9 is a top view of coating of a distributed network according to one embodiment of the present invention.

As shown in FIG. 1, one side of the carrier plate 1 seals off the environment. On its inner surface, the carrier plate has electrically conductive patches 11, which, as is to be seen from FIG. 2, may be square in shape, for example, and be spaced at regular intervals from each other. These electrically conductive patches can be any suitable material, such as a suitable conductive metal, and may be applied in any suitable manner, such as being vapor deposited, laminated, or printed. Opposite each patch 11 is a coupling network consisting of slot-like openings (coupling slots) in the metal layer 2, as shown by FIG. 8. Layer 2 rests on the foam layer 23. On the reverse side of layer 23 is located a distribution network 22, as shown in FIG. 9, by means of which the transmittivity of the coupling slot 21 are controlled. The leads required for this purpose are on the reverse side of the foamed material 23. The ground plane 3 provides a seal from the environment. It consists of metal or is designed as a metallic reflector.

In accordance with further aspects of the invention, three additional modifications of the SSFIP technology are utilized which, for the most part, contribute the bandwidth enlargement or reduction of the reflection factor.

First, the openings 21 in the radiation plate 2 can be H-shaped and butterfly-shaped, as illustrated by the configuration in FIG. 3, in addition to being in the form of slots.

Figure 4:
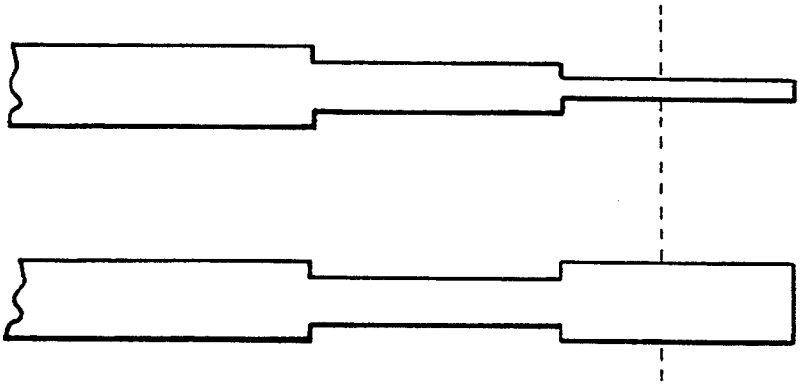
FIG. 4 illustrates impedance matching of the conducting strip networks to the coupling slots in accordance with the present invention.

Second, the stub cables (under the openings 21) in the distribution network 22 are impedance matched. Two forms of such fully matched strip conductor networks are shown in FIG. 4.

Figure 5:
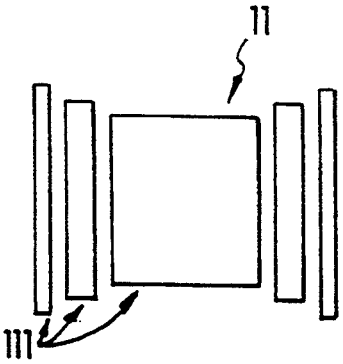
FIG. 5 shows a typical form of a slotted patch adapted for wideband operation.

Also, the radiation elements (patches 11) may be square, round, rectangular, or cross-shaped or may have a series of strips of equal or unequal length and varying width. A typical patch in strip form is shown in FIG. 5. The length of the various segments 111 of a patch is adjusted in such a way that the frequency band of each segment overlaps a part of the overall desired frequency spectrum (and consequently each coupling slot is tuned to the particular frequency associated with each patch).

In contrast to the above-referenced *Electromagnetics* publication, the antenna of the present invention is constructed having substrates no longer consisting of Teflon ® or a ceramic, but are made of less costly materials. Carrier plate 1, for example, consists of easily disposable glass. Glass as a seal against the environment presents a great advantage in that it can withstand all harmful environmental influences and can easily be cleaned when necessary. In addition, an antenna of this design could be easily and simply integrated into the facades of high-rise buildings. The coupling network is mounted between foamed material and air, and in this instance, is held in position relative to Carrier plate 1 by spacers.

The antenna may be assembled with one or more elements (patches). Several elements may be arranged either in a column or side by side.

Figure 6:
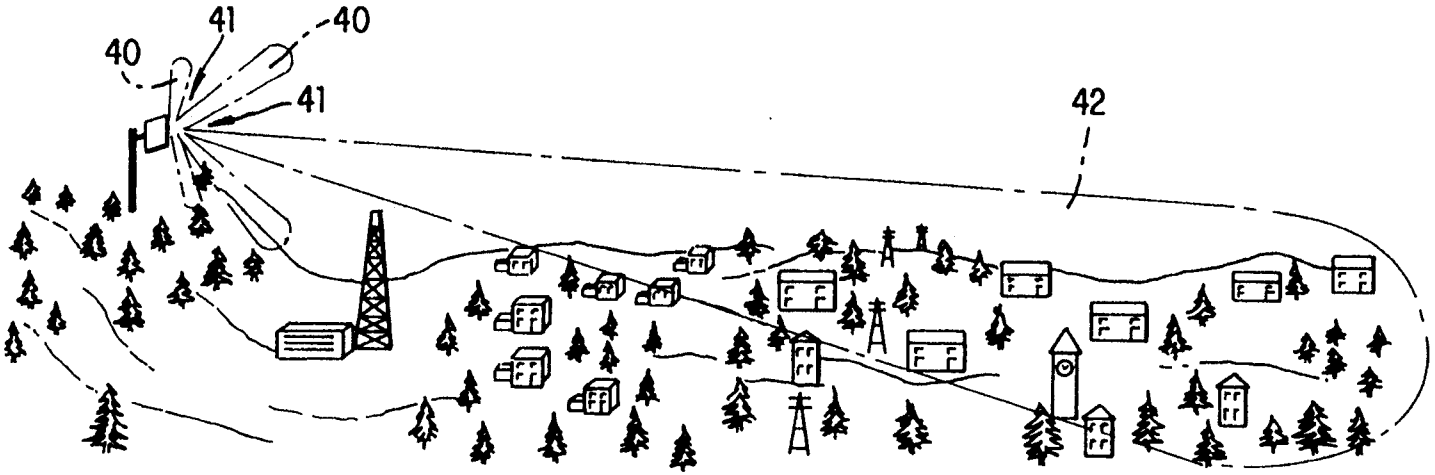
FIG. 6 illustrates a vertical propagation pattern with unadjusted re-radiation.

The customary vertical radiation pattern as illustrated in FIG. 6 exhibits distinct zero settings 41 between the individual beams 40, 42. Controlling the coupling slots 21 by means of the distribution network 22 allows uniform illumination of the area to be irradiated. In the examples discussed in the foregoing, it has been customary with the state-of-the-art equipment for the direction of maximum radiation to be positioned perpendicular to the plane of the antenna, so that this antenna plane has had to be mounted obliquely for illumination, as shown in FIG. 6.

Figure 7:
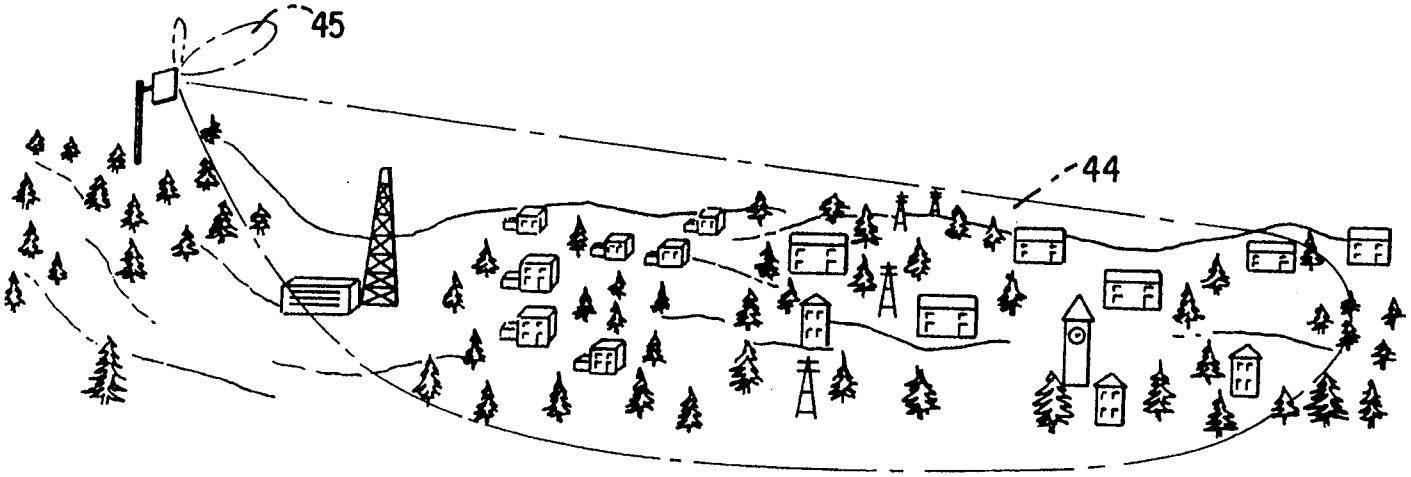
FIG. 7 shows a vertical propagation pattern wherein the re-radiation is adjusted.
Figure 1:
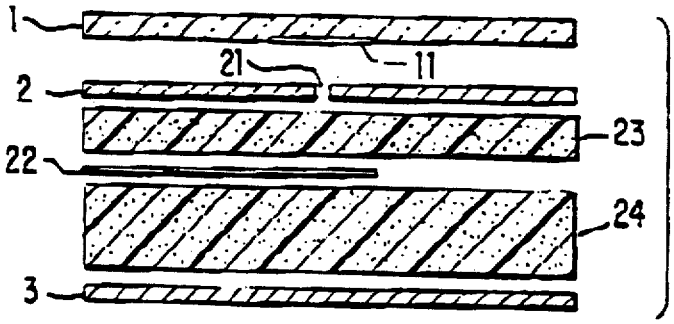
Figure 3A:
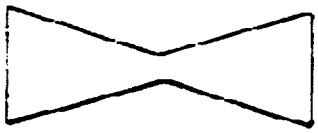
Figure 3B:
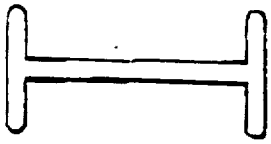
Figure 5:
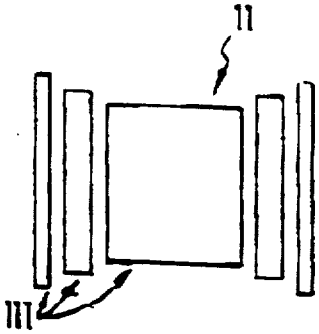
Figure 4:
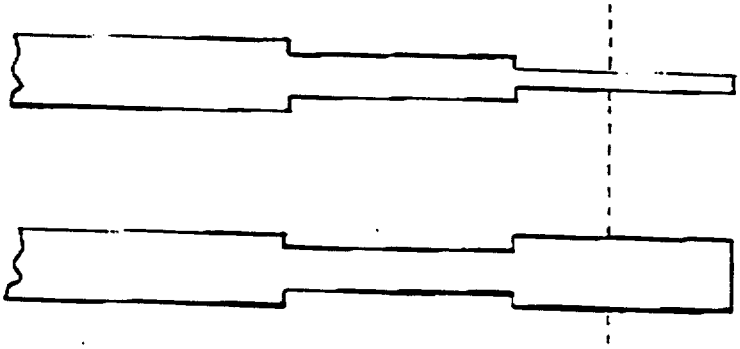

The antenna design of the present invention now makes it possible to orient the direction of maximum radiation in a limited range, from the electrical viewpoint at any rate, so that the plane of the antenna can be mounted independently of the direction of maximum radiation, as is clearly seen from FIG. 7. In addition to the suitably shaped major lobe 44 as shown in FIG. 7, a side lobe 45, for example, can be directed and amplified in such a way that an area so remote as not to be irradiated by the major lobe 44 can be illuminated. In addition to generation of an optimized vertical radiation pattern, generation of the horizontal beam direction at any desired angle of approximately ±30° to the vertical of the plane of the antenna is possible. Similarly, more than one arbitrary direction of radiation is also possible in the horizontal plane.

In the past, it has been possible to build antennas measuring up to about only 30 cm by 30 cm as a result of constraints imposed by costs, technology, and the manufacturing process. According to the present invention, antennas can be built which are suitable for reception by way of satellites for music broadcasting, flat antennas 3 to 4 cm thick and of almost any desired size. The only constraints imposed are represented firstly by the glass area that can be obtained, and secondly, by the area that can be printed by screen printing.

Figure 2:
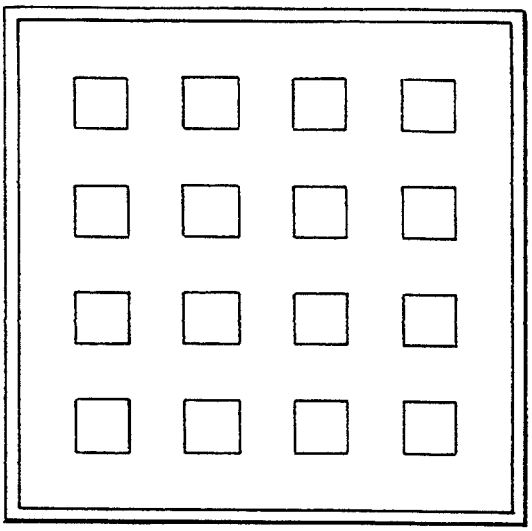
FIG. 2 illustrates a top view of a patch pattern on the antenna according to the present invention.

In the example shorn in FIG. 2, the patches are drawn as squares. It is obvious to any expert, however, that other geometric shapes are possible as patches, as for example circular areas, ellipses or rectangles, or parallel strips.

We claim:

1. An aperture-coupled planar antenna having an adjustable directional radiating pattern created by at least one antenna element, comprising:

a ground plane;

a first dielectric layer formed over said ground plane;

a second dielectric layer formed over said first dielectric layer;

a feeding network having at least one feed line formed between said first and second dielectric layers;

a coupling network formed over said second dielectric layer and having at least one coupling slot respectively aligned with said at least one feed line; and a carrier plate formed over said coupling network and having formed thereon at least one radiating patch constituting said at least one antenna element, respectively aligned with said at least one coupling slot;

wherein said at least one radiating patch is formed by at least two patch segments for each antenna element, wherein the length of each of said patch segments is preadjusted such that the frequency band thereof overlaps a part of the overall desired frequency spectrum of said antenna, and wherein said at least one coupling slot is butterfly shaped.

2. An aperture-coupled planar antenna having an adjustable directional radiating pattern created by at least one antenna element, comprising:

a ground plane;

a first dielectric layer formed over said ground plane;

a second dielectric layer formed over said first dielectric layer;

a feeding network having at least one feed line formed between said first and second dielectric layers;

a coupling network formed over said second dielectric layer and having at least one coupling slot respectively aligned with said at least one feed line; and a carrier plate formed over said coupling network and having formed thereon at least one radiating patch constituting said at least one antenna element, respectively aligned with said at least one coupling slot;

wherein said at least one radiating patch is formed by at least two patch segments for each antenna element, wherein the length of each of said patch segments is preadjusted such that the frequency band thereof overlaps a part of the overall desired frequency spectrum of said antenna, and wherein said at least one coupling slot is shaped in the form of the letter H.

3. An antenna according to claim 1 or claim 2, wherein said at least two patch segments for each antenna element are of different lengths.

4. An antenna according to claim 1 or claim 2, wherein the thickness of said first dielectric layer is different from the thickness of said second dielectric layer.

5. An antenna according to claim 1 or claim 2, wherein said carrier plate is formed of glass.

6. An antenna according to claim 1 or claim 2, wherein said carrier plate is formed of a fiber composite.

7. An antenna according to claim 1 or claim 2, wherein said ground plane is formed of metal.

8. An antenna according to claim 1 or claim 2, wherein said ground plane is formed of a metallic reflector.

9. An antenna according to claim 1 or claim 2, wherein said first and second dielectric layers are formed of material having relatively low permittivity.

10. An antenna according to claim 9, wherein first and second dielectric layers are formed of foam material.

11. An antenna according to claim 1 or claim 2, wherein said first and second dielectric layers are formed of material having relatively low density.

12. An antenna according to claim 11, wherein said first and second dielectric layers are formed of foam material.

13. An antenna according to claim 1 or claim 2, wherein said coupling network consists of a metal layer having said at least one coupling slot formed therein.

14. An antenna according to claim 1 or claim 2, wherein said adjustable directional radiating pattern is created by 16 antenna elements arranged in a 4×4 array, said coupling network comprises 16 coupling slots aligned with said 16 antenna elements, and said feeding network comprises 16 feed lines each associated with a respective coupling slot and corresponding antenna element.

* * * * *

UNITED STATES PATENT AND TRADEMARK OFFICE

CERTIFICATE OF CORRECTION

PATENT NO. : 5,355,143

DATED : October 11, 1994

INVENTOR(S) : Jean F. Zurcher, et al.

It is certified that error appears in the above-indentified patent and that said Letters Patent is hereby corrected as shown below:

The title page should be deleted to appear as per attached title page.

Sheet 1 of 3 of the Drawings, should be deleted to appear as per attached sheet.

Signed and Sealed this

Twenty-second Day of August, 1995

*Attest:*

Bruce Lehman

BRUCE LEHMAN

*Attesting Officer*

*Commissioner of Patents and Trademarks*

United States Patent [19]

Zürcher et al.

[11] Patent Number: 5,355,143

[45] Date of Patent: Oct. 11, 1994

[54] ENHANCED PERFORMANCE APERTURE-COUPLED PLANAR ANTENNA ARRAY

[75] Inventors: Jean F. Zürcher, Tavel sur Clarens; John R. Sanford, Oberutzwil; Kuno Wettstein, Schwellbrunn; Richard C. Hall, Herisau, all of Switzerland

[73] Assignee: Huber & Suhner AG, Kabel-, Kautschuk-, Kunststoffwerke, Herisau, Switzerland

[21] Appl. No.: 82,905

[22] Filed: Jun. 28, 1993

Related U.S. Application Data

[63] Continuation of Ser. No. 847,301, Mar. 6, 1992, abandoned.

[30] Foreign Application Priority Data

Mar. 6, 1991 [CH] Switzerland ..... 680/91
Dec. 4, 1991 [CH] Switzerland ..... 3584/91

[51] Int. Cl.[5] ..... H01Q 1/38; H01Q 13/10

[52] U.S. Cl. ..... 343/700 MS; 343/767; 343/770

[58] Field of Search ..... 343/700 MS, 767, 778, 343/768, 770, 829, 845, 846, 847, 848; H01Q 1/38

[56] References Cited

U.S. PATENT DOCUMENTS

| | | | |
|---|---|---|---|
| 4,761,654 | 8/1988 | Zaghloul | 343/700 MS |
| 4,816,835 | 3/1989 | Abiko et al. | 343/700 MS |
| 4,843,400 | 6/1989 | Tsao et al. | 343/700 MS |
| 4,926,189 | 5/1990 | Zaghloul et al. | 343/700 MS |
| 4,929,959 | 5/1990 | Sorbello et al. | 343/700 MS |
| 4,943,809 | 7/1990 | Zaghloul | 343/700 MS |
| 5,005,019 | 4/1991 | Zaghloul et al. | 343/700 MS |
| 5,008,681 | 4/1991 | Gavallaro et al. | 343/700 MS |

FOREIGN PATENT DOCUMENTS

| | | | |
|---|---|---|---|
| 0253128 | 6/1987 | European Pat. Off. | H01Q 21/24 |
| 0342175 | 5/1989 | European Pat. Off. | H01Q 9/04 |

OTHER PUBLICATIONS

*Electronics Letters*, No. 23, 24:1433–35 (Nov. 1988).

Papiernik et al., *Antennes Microrubans A Large Bande Alimentees Par Ouverture*, 6es Journees Nationales Microondes (Jun. 1989) pp. 113–114.

*1990 International Symposium Digest Antennas and Propogation, I.E.E.E.*, vol. III, pp. 1154–1157 (May 1990).

*Primary Examiner*—Donald Hajec
*Assistant Examiner*—Hoanganh Le
*Attorney, Agent, or Firm*—Rothwell, Figg, Ernst & Kurz

[57] ABSTRACT

A flat antenna is disclosed which consists of a substrate having applied thereto an electrically conductive elements, or patches, in a pattern and a metal layer having a slot pattern aligned with the patches, as well as a distribution network mounted on both sides thereof a layer of foamed material. The antenna further includes a reflector consisting of a metal plate. The external surface of the antenna, consisting of a glass substrate surface, can easily be cleaned. Such an antenna can be manufactured inexpensively by using glass and a foamed material. The various patch patterns can be created by screen printing or metallization. The propagation pattern may be shaped as desired the antenna constructed according to the present invention.

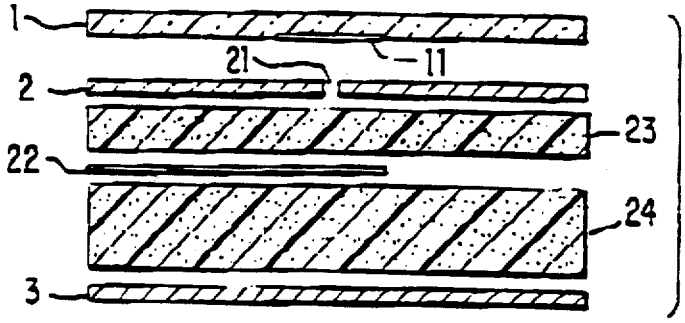

14 Claims, 3 Drawing Sheets